United States Patent [19]

Fang

[11] Patent Number: 5,069,441

[45] Date of Patent: Dec. 3, 1991

[54] BASKETBALL TRAINING ASSEMBLY WITH MULTIPLE HOOPS

[76] Inventor: Yao-chien Fang, 178, Chung Shui Road, Chunghua, Taiwan

[21] Appl. No.: 388,522

[22] Filed: Aug. 2, 1989

[51] Int. Cl.[5] ..... A63B 63/08

[52] U.S. Cl. ..... 273/1.5 A

[58] Field of Search ..... 273/1.5 A, 1.5 R, 398–402

[56] References Cited

U.S. PATENT DOCUMENTS

| | | | |
|---|---|---|---|
| 1,211,379 | 1/1917 | Maisch | 273/400 |
| 1,531,614 | 3/1925 | Houston | 273/1.5 R |
| 1,616,270 | 2/1927 | Madden | 273/401 |
| 1,695,937 | 12/1928 | Welch | 273/400 |
| 2,724,594 | 11/1955 | Anderson | 273/352 |
| 2,886,321 | 5/1959 | Tarte, Jr. | 273/354 |
| 2,893,734 | 7/1959 | Tarte, Jr. | 273/1.5 R |
| 3,050,304 | 8/1962 | Holsebus | 273/1.5 R |
| 3,244,420 | 4/1966 | Poynter | 273/1.5 A |
| 3,362,712 | 1/1968 | Wagner | 273/1.5 R |
| 3,788,642 | 1/1974 | Matras et al. | 273/1.5 R |
| 4,492,380 | 1/1985 | Saytar | 273/400 |
| 4,936,577 | 6/1990 | Kington et al. | 273/1.5 A |

FOREIGN PATENT DOCUMENTS

| | | | |
|---|---|---|---|
| 82728 | 2/1964 | France | 273/1.5 R |
| 256803 | 8/1926 | United Kingdom | 273/402 |

*Primary Examiner*—Benjamin Layno

[57] ABSTRACT

A basketball training assembly with multiple hoops comprises a backboard, an innermost circular hoop, a middle semi-circular hoop, and an outermost semi-circular hoop. Each of the hoops has a net, and the hoops are concentric. The hoops are connected to the backboard perpendicularly by connecting means such as screws and nuts. The diameter of the innermost hoop is the smallest, and the diameter of the outermost hoop is the largest. The distance between every two hoops is greater than the diameter of a basketball for the basketball passing therethrough.

2 Claims, 2 Drawing Sheets

BASKETBALL TRAINING ASSEMBLY WITH MULTIPLE HOOPS

BACKGROUND OF THE PRESENT INVENTION

The present invention relates to a basketball training assembly with multiple hoops, and more particularly, it provides multiple hoops on the backboard for the children or novices to practice the shooting and have the entertainment when they play the basketball.

Accordingly, basketball is a well-known popular sport. People who play the basketball could not be classified by their ages, jobs or political opinions. The back pass, defensive dribble, underhand flip, hook pass, pivot shot, slam and clean shot always attract us and hold our breath. Especially the "swish" and the curve of a clean shot always makes people feel good and smooth. It's hard to know exactly how many people who love the basketball actually want nothing but to watch and hear a clean shot. But one thing could be sure that clean shot always turns them on. However, to watch a cage ace to play basketball is one thing, to practice by oneself is another. To novices and children, the shooting always turns them off. For encouraging them to be familiar with this shooting skill or just do some exercise, the inventor here provides an apparatus for the beginners' training and entertainment.

SUMMARY OF THE PRESENT INVENTION

The main object of the present invention is to provide a basketball training assembly with multiple hoops for training and entertainment.

The basketball training assembly with multiple hoops comprises a backboard and three concentric hoops of arranged different diameters.

BRIEF DESCRIPTION OF THE PREFERRED EMBODIMENT

DETAILED DESCRIPTION OF THE PREFERRED EMBODIMENT

Figure 1:
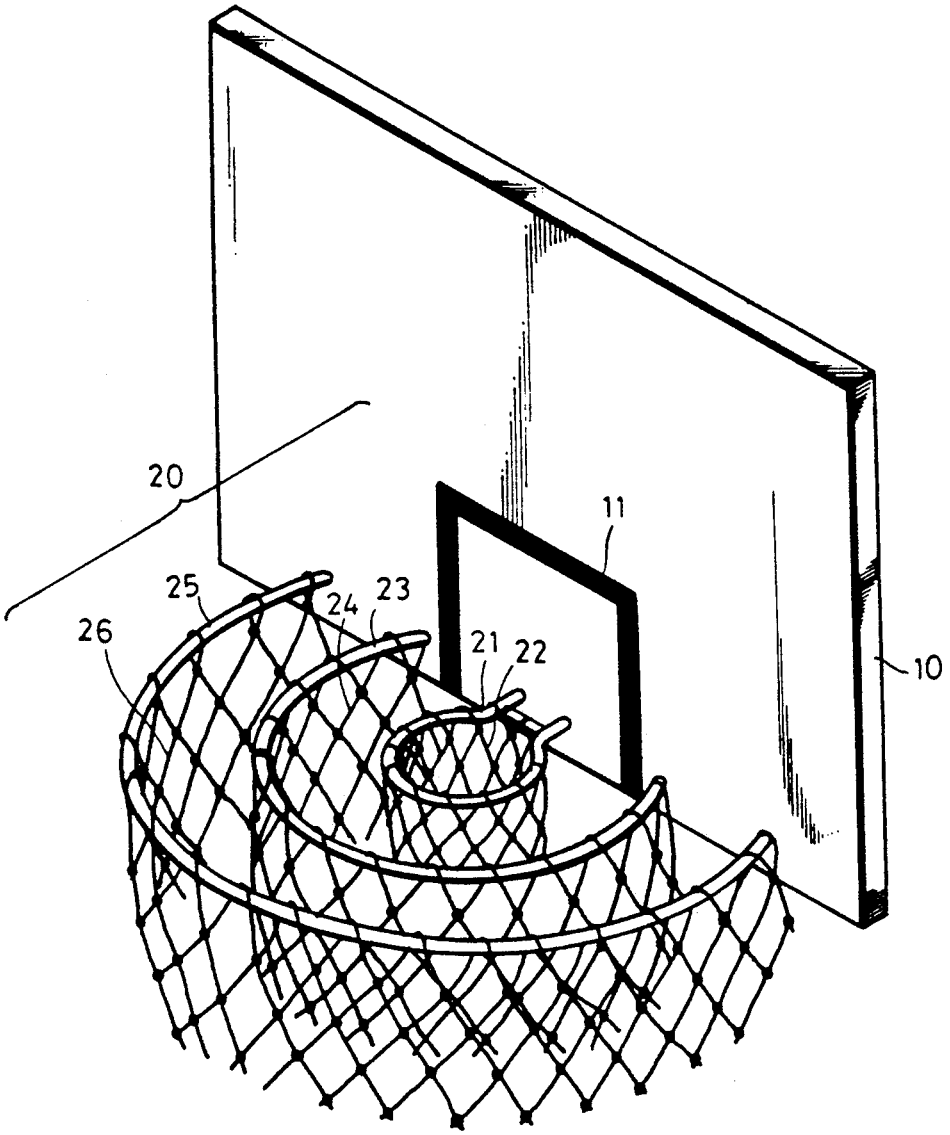
FIG. 1 is a perspective diagram of one preferred embodiment of the present invention.

Referring to FIG. 1, a basketball training assembly with multiple hoops comprises a backboard 10 and a hoop assembly 20 with nets perpendicular to the backboard 10. The backboard 10 and a central square 11 which marked on the backboard 10 and an innermost hoop 21 with a net 22 are conventional arts i.e., the usual backboard and hoop with net. Hoops 23 and 25 with nets 24 and 26 respectively are concentric with the innermost hoop 21. All three hoops 21, 23 and 25 lie on the same plane and perpendicular to the backboard 10. The hoop 21 has the smallest diameter. The greater the diameter of the hoop 21, 23 or 25 is, the farther outside it will be positioned as in the arrangement of the hoops 21, 23 and 25 as shown in FIG. 1.

Figure 2:
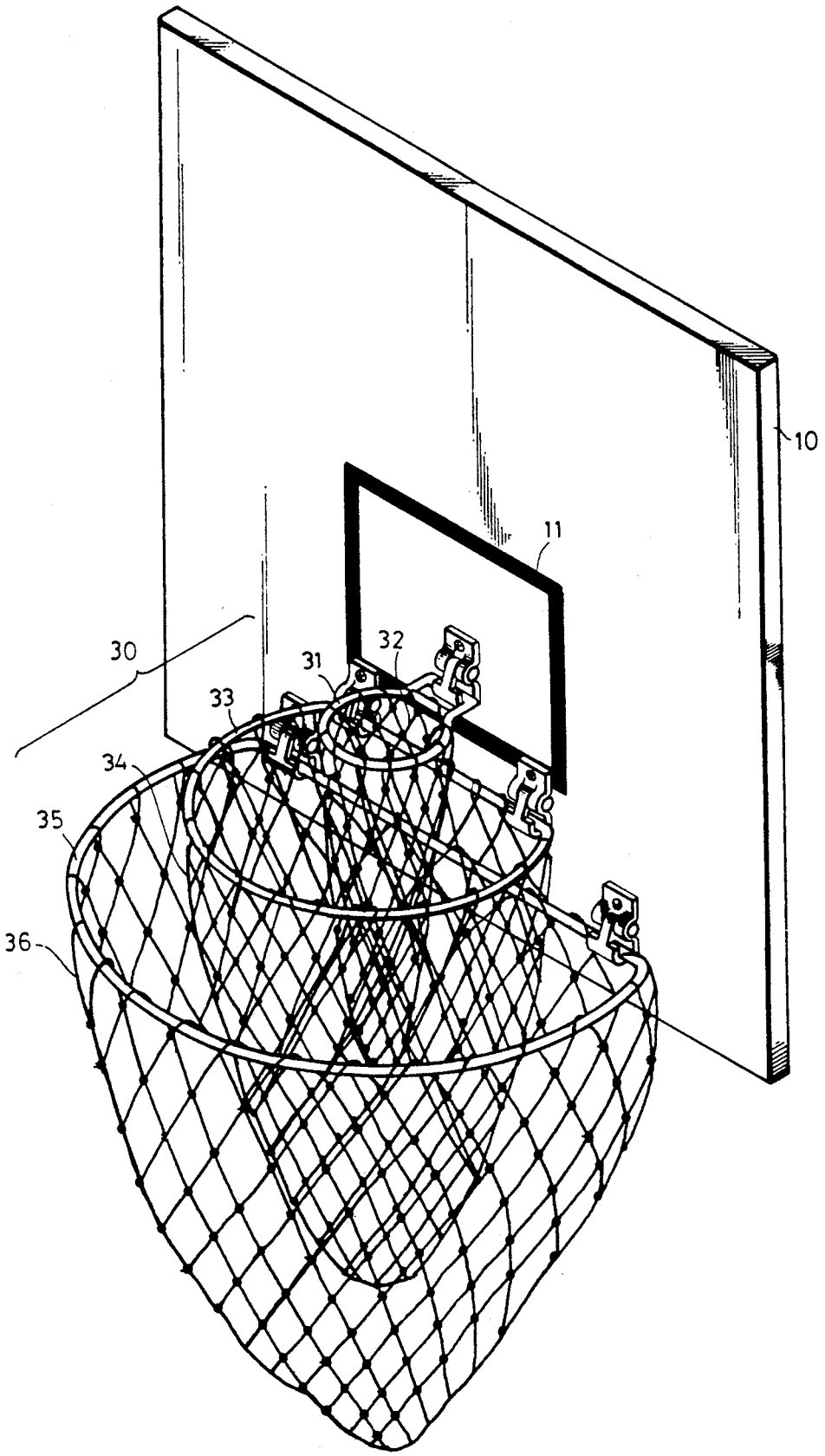
FIG. 2 is a perspective diagram of another preferred embodiment of the present invention.

Referring to FIG. 2, another arrangement of the preferred embodiment of the present invention which comprises a backboard 10 and a hoop assembly 30 perpendicular to the backboard 10. The backboard 10 and a central square 11 which marked on the backboard 10 and an innermost hoop 31 with the same diameter as the usual one are conventional arts. But there are a plurality of concentric hoops 33 and 35 and closed nets 32, 34, 36 are new designs, compared to the conventional backboard and hoop of the basketball. Each hoop is on a different plane. The larger the diameter of the hoop 31, 33, or 35 is, the lower the hoop 31, 33 or 35 is disposed such as the arrangement of the hoops 31, 33 and 35 as shown in FIG. 2. Hoops 33 and 35 with nets 34 and 36 respectively are concentric with the innermost hoop 31. Therefore, the three hoops 31, 33 and 35 are dispoed on different planes.

Although there are some differences between these two arrangements, there are two basic principles which they both share. First, since the hoops 21, 23, 25 or 31, 33, 35 are concenctric, their center of circle should be in the center of the innermost hoop 21 or 31, then again the hoops 23, 25 or 33, 35 are approximately semi-circular in shape, the outer hoop has the less degrees of circle measure than the inner one, the diameter of the outer hoop is greater than that of the inner one, and of course the diameter of the outermost hoop is not greater than the length of the periphery which the hoops 21, 23, 25 or 31, 33, 35 connect with. Secondly, the distance between two hoops is greater than the diameter of a basketball. The hoops 21 and 31 are neraly in circular shape.

The diameters of the innermost hoops 21 and 31 are also larger than the diameter of a basketball respectively, as both the horizontal and vertical distance between the two hoops 21 and 23, 23 and 25, or 31 and 33, 33 and 35 is large enough that it is suitable for a basketball passing through. For encouraging children and novices, the hoops are removable. When the hoops 21 and 23 or 31 and 33 are removed, only the largest semi-circular hoop 25 or 35 will still be hung on the backboard 10. When the shooting accuracy of the user is improved, the largest semi-circular hoop 25 or 35 is replaced with the smaller semi-circular hoop 23 or 33.

The three hoops on a backboard can improve the entertainment also. If the basketball enters the innermost hoops, it scores three points. If the basketball enters the middle hoop, it scores two points. If the basketball enters the outermost hoop, it only scores one point. Therefore, the novel basketball game will become more interesting than a conventional basketball game.

I claim:

1. A basketball training assembly with multiple hoops comprising:

a backboard, an innermost circular hoop, a middle semi-circular hoop, and an outermost semi-circular hoop;

said hoops being concentric and each of said hoops having a respective net thereof;

said hoops being perpendicularly connected to said backboard on the same plane by connecting means such as screws and nuts on the same plane;

the diameter of said innermost hoop being the smallest, and the diameter of said outermost hoop being the largest;

whereby the distance between every two of said hoops is slightly greater than the diameter of a basketball for the basketball passing therethrough.

2. A basketball training assembly with multiple hoops comprising:

a backboard, an innermost circular hoop, a middle semi-circular hoop, and an outermost semi-circular hoop;

each of said hoops being concentric and having a respective net thereof;

the diameter of said innermost hoop being the smallest, and the diameter of said outermost hoop being the largest;

said hoops being connected to said backboard perpendicularly by connecting means such as screws and nuts on different planes;

wherein the larger the diameter of said hoop is, the lower said hoop is disposed respectively;

whereby both the horizontal and vertical distances between every two of said hoops are slightly greater than the diameter of a basketball for the basketball passing therethrough respectively.

* * * * *